US005126109A

United States Patent [19]

Saitoh

[11] Patent Number: 5,126,109

[45] Date of Patent: Jun. 30, 1992

[54] PRESERVING MATERIAL AND METHOD FOR PRODUCING THE SAME

[75] Inventor: Hachiro Saitoh, Yokosuka, Japan

[73] Assignee: Nippon Petrochemicals Company, Limited, Tokyo, Japan

[21] Appl. No.: 693,631

[22] Filed: Apr. 30, 1991

Related U.S. Application Data

[63] Continuation-in-part of Ser. No. 253,757, Oct. 5, 1988, abandoned.

[30] Foreign Application Priority Data

Mar. 12, 1988 [JP] Japan ..... 63-58945

[51] Int. Cl.[5] ..... B01J 19/00

[52] U.S. Cl. ..... 422/40; 422/28; 422/29; 422/32; 426/124; 426/316; 426/324; 426/326

[58] Field of Search ..... 422/28, 29, 32, 40; 426/124, 316, 324, 326

[56] References Cited

U.S. PATENT DOCUMENTS

| | | | |
|---|---|---|---|
| 3,698,974 | 10/1972 | Rabussier et al. . | |
| 3,908,031 | 9/1975 | Wistreich et al. . | |
| 4,550,026 | 10/1985 | Ando . | |
| 4,863,688 | 9/1989 | Schmidt et al. | 422/28 |
| 4,896,768 | 1/1990 | Anderson | 422/22 |
| 4,897,273 | 1/1990 | Kotaki et al. . | |

FOREIGN PATENT DOCUMENTS 54-132247 of 0000 Japan .

*Primary Examiner*—James C. Housel
*Assistant Examiner*—Lyle Alexander
*Attorney, Agent, or Firm*—Scully, Scott, Murphy & Presser

[57] ABSTRACT

A preserving material of a layered structure which is composed of an impregnated absorbent sheet containing a preserving liquid and impermeable barrier films being bonded to both surfaces of the adsorbent sheet. The effective components of the preserving liquid is evaporated gradually from the peripheral edges of the preserving material.

6 Claims, 1 Drawing Sheet

PRESERVING MATERIAL AND METHOD FOR PRODUCING THE SAME

CROSS-REFERENCE TO RELATED APPLICATION

This application is a continuation-in-part of application Ser. No. 253,757 filed Oct. 5, 1988 now abandoned.

BACKGROUND OF THE INVENTION

1. Field of the Invention

This invention relates to a preserving material and a method for producing the same. More particularly, the invention relates to a preserving material which can maintain the freshness of foodstuff or the like avoiding the deterioration of them. The preserving material of the present invention is characterized in that it can be conveniently sealed into packages of foodstuffs and the like to be preserved and the preserving liquid contained in the preserving material is not brought into direct contact with substances to be preserved in packages.

Furthermore, the present invention relates to a method for producing a preserving material inexpensively in a continuous manner. The component layers of the preserving material are well bonded together and hardly peeled off.

2. Description of the Prior Art

It has been well known that ethyl alcohol is useful for sterilizing or for inhibiting the growth of microorganisms in order to preserve foodstuffs such as bread, fish, meat, fruits and vegetables.

For example, it is disclosed in Japanese Patent Publication No. 55-1787 that ethanol is directly sprayed to the surface of foodstuffs. Similar methods to use ethanol are disclosed also in U.S. Pat. No. 3,908,031 and Canadian Patent No. 699,278.

In these methods, however, even though the effect of preservation is good, they are not desirable in view of external appearance and commercial value of foodstuffs because the natural good quality of foodstuff is lost and flavors and coloring agents sometimes ooze out owing to the process that foodstuffs are applied with a thin layer of alcohol.

In Japanese Patent Publication No. 40-25228 and No. 55-2273, it is disclosed that ethanol is adsorbed by an adsorbent composed of the powders of starch, dextrin, gelatin, cellulose, silicon dioxide, aluminum silicate and talc and it is sealed together with a foodstuff in a gastight container.

In this method, however, because the bulky adsorbent powders such as starch and silicon dioxide are used and the surface areas of powders are very large, the rate of evaporation of the adsorbed alcohol is too large. Therefore, the effect of preservation cannot be maintained for a long period of time.

That is, in the case that the evaporation of alcohol from an adsorbent is too large, it is necessary that foodstuff packing is carried out soon after the adsorption of alcohol by an adsorbent, which causes difficulties in packing process. Because the leakage of alcohol gas from packages of foodstuffs cannot be avoided completely, a long time preserving effect is not produced when packages are not replenished with alcohol. In other words, in order to maintain the concentration of alcohol above a certain level, it is preferable that the evaporation of alcohol controlled and reduced to a lower rate.

Furthermore, when foodstuffs are preserved using these ethanol-carrying powder, a bag or other container to hold the powder is inevitable, so that the process for packing foodstuff is complicated which increases the packing cost. In addition, if the container of the adsorbent powder happen to break down, the foodstuff in the package is contaminated with the adsorbent powder.

Besides the foregoing ones, there are many other references with regard to the use of preserving agents. For the purpose of information, some references are listed below. It is to be noted, however, that the references do not relate directly to the present invention because the present invention is not intended to provide any preserving agent itself but to propose a novel preserving material of layered structure and a method for producing the same.

a) Preservation of foodstuffs using ethanol and organic acids or their esters:

Japanese Patent Publication No. 50-25531, No. 52-27217, No. 53-28485, No. 55-01787, No. 55-02274, No. 55-50674, No. 58-49156 and No. 58-49157, and U.S. Pat. No. 4,550,026.

b) Preservation using ethanol and deoxidizing agents.

Japanese Patent Publication No. 57-79869, No. 57-079870 and No. 60-70053.

c) Preservation using ethanol in solid form:

Japanese Patent Publication No. 60-184374, No. 62-69971 and No. 62-232365.

d) Preservation using deoxidizing agents:

Japanese Patent Publication No. 48-11026, No. 50-04740, No. 51-34898, No. 53-33665, No. 55-44594, No. 57-18787, No. 58-29069, No. 59-32106, No. 60-30503, No. 60-30504, No. 60-31465, No. 60-35102, No. 60-36747, No. 61-17463, No. 61-36912, No. 61-36913 and No. 61-36914.

e) Preservation using other agents:

British Patent No. 1,277,874 (propionic acid), U.S. Pat. No. 3,346,398 (alkylene oxides), U.S. Pat. No. 3,533,806 (carbon tetrachlrride and glacial acetic acid), U.S. Pat. No. 3,600,198 (propionic acid and benzoic acid), U.S. Pat. No. 3,595,665 (acetic, propionic and formic acids), U.S. Pat. Nos. 4,350,709 and 4,421,774 (sulfur dioxide, organic acid such as propionic acid and ammonia gas), U.S. Pat. No. 4,356,204 (ketohexanoic acids), U.S. Pat. No. 4,404,340 ($C_6$-$C_{14}$ fatty acids), U.S. Pat. No. 32,416 (acid propionate salt), Australian Patent No. 102,824 ($C_3$-$C_{12}$ saturated aliphatic monocarboxylic acids) and Austalian Patent No. 110,824 (halogenated hydrocarbon containing dichloromethyl group).

Conventionally known methods have several disadvantages in that some methods deprive foodstuffs of natural quality or flavor; they spoil external appearance of foodstuffs the effect of preservation cannot be maintained for a long period of time; absorbent or adsorbent material and gastight container are required; and as mentioned in the foregoing paragraphs, the process for the package of foodstuffs cannot be easy and simple and foodstuffs are liable to be contaminated by preserving agents.

BRIEF SUMMARY OF THE INVENTION

It is, therefore, the object of the present invention to eliminate the above-described disadvantages in the conventional art.

That is, in accordance with the present invention, it is possible to prevent foodstuffs from the deterioration of taste caused by the direct contact with a preserving agent and the contamination caused by the oozing out of a preserving agent. Furthermore, the rate of evaporation of preserving agent can be controlled properly for a long period of time so as to maintain the concentration of a preserving agent on a level suitable to avoid the growth of microorganisms. In addition, according to the present invention, the operation to soak en adsorbing material into a preserving agent can be done easily in a short time and it is convenient that the preserving material of the invention can be simultaneously packed together with foodstuffs.

According to the present invention, the preserving material is characterized in a layered structure which is composed of an impregnated adsorbent sheet containing a preserving liquid and films applied to both surfaces of the adsorbent sheet, which films are impermeable to the preserving liquid. Incidentally, the above films are sometimes hereinafter referred to as "barrier films". Furthermore, it should be noted that the terms "adsorb", "adsorption" and "adsorbent" are intended to mean both the sates relating to adsorption and absorption a far as these terms can be applied to in this invention. In the preserving material of the invention, the effective component of the preserving liquid is evaporated little by little from the peripheral edges of the preserving material.

The method for producing a preserving material consists of the steps of: applying barrier films to both surfaces of an adsorbent sheet; and soaking the obtained layered material in a preserving liquid which contains at least a lower alcohol, thereby impregnating the adsorbent sheet with the preserving liquid from the edge portions of the layered material.

BRIEF DESCRIPTION OF DRAWINGS

These and other objects and features of the present invention will become more apparent from the following description taken in connection with the accompanying drawings, in which.

DETAILED DESCRIPTION OF THE INVENTION

Figure 1:
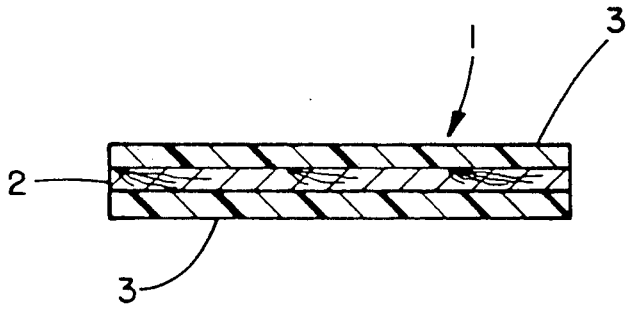
FIG. 1 is a vertical cross-sectional view of an embodiment of the preserving material according to the present invention.

The preserving material and the method for producing the same will be described in more detail.

The adsorbent sheet used in the present invention is one member selected from the group consisting of papers such as thick paper board, woven or nonwoven fabric made of natural pulp or polyolefin fiber, foamed plastics sheet, cotton wool and plastics sheet which is impregnable with the preserving liquid.

The above plastics sheet which is impregnable with the preserving liquid is exemplified by the copolymers of ethylene and a monomer containing polar group such as ethylene-vinyl acetate copolymer, ethylene-ethyl acrylate copolymer and ethylene-ethyl methacrylate copolymer.

The barrier films are at least one member selected from the group consisting of thermoplastic resin films such as those made of polyolefin, polystyrene, polyamide, polyester, polyvinyl chloride, polyvinylidene chloride, saponified product of ethylene-vinyl acetate copolymer and vinyl alcohol; the thermoplastic resin films applied with metallic vacuum evaporation coating; metal foils such as aluminum foil and nickel foil; and regenerated cellulose film. As the barrier film, transparent films are preferable. When a film is printed, reverse printing is more preferable in view of food sanitation.

As the preserving liquid used in the present invention, it is possible to use lower alcohols such as methyl alcohol, ethyl alcohol and isopropyl alcohol or a mixture of these alcohols with edible organic acids, fatty acids or their esters, or polyhydric alcohols. Especially, because the preserving material is used for foodstuffs, ethyl alcohol is most preferable. When ethyl alcohol is used together with at least another kind of the above compounds such as an edible organic acid, it is possible to avoid the irritating smell and the oozing out of flavor or dyestuff caused by the use of ethyl alcohol. In addition, the effect of preservation can be much improved.

The foregoing edible organic acids are exemplified by lactic acid, malic acid, fumaric acid, citric acid, acetic acid, succinic acid, tartaric acid, gluconic acid, adipic acid, ascorbic acid and phytic acid.

The fatty acids or their esters are exemplified by formic acid, propionic acid, butyric acid, caproic acid, enanthic acid, capric acid, caprylic acid, or their esters. The polyhydric alcohols are exemplified by ethylene glycol, propylene glycol, glycerol, sorbitol, xylitol and mannitol.

The preserving material of the present invention will be described with reference to several examples shown in the attached drawings.

FIG. 1 is a vertical cross-sectional view of a basic embodiment 1 of the preserving material according to the present invention. A preserving material 1 has a layered structure which is composed of an adsorbent sheet 2 and barrier films 3 which are applied to both surfaces of the adsorbent sheet 2. The preserving liquid impregnated to the adsorbent sheet 2 is released little by little from the peripheral edges of the layered structure.

The method for producing the preserving material of the present invention is as follows.

Barrier films are applied to both surfaces of the adsorbent sheet by means of an adhesive agent, thermal fusion or extrusion lamination to obtain a layered structure. The layered structure is preferably cut into several centimeter square pieces and they are soaked in a preserving liquid. Thus, pieces of the adsorbent sheet are impregnated with the preserving liquid from the peripheral edges of the adsorbent sheet.

Accordingly, the evaporation of the preserving liquid is caused to occur in the peripheral edge portions of the adsorbent sheet. The evaporation of alcohol having a relatively high evaporation rate can be thus controlled appropriately.

The preserving material according to the present invention can be produced by a continuous process. That is, a layered structure is continuously prepared by using multi-layer free blown film technique or multi-layer casting film technique. When the obtained layered structure is free blown films, the peripheral edges of them are torn off. When the obtained layered structure is a cast film sheet, the edges are trimmed. Then these are passed through a preserving liquid vessel for a predetermined retention time and then wound up to be stored.

It is possible to control the rate of evaporation of the preserving liquid by the combined use of organic acids with alcohol. The shape of preserving material can also be determined arbitrary in view of uses and type of packages, for example, square, rectangle, triangle, circle and so forth.

In one example of use, the preserving material is made in the form of chips and they are sealed in a package together with a foodstuff, thereby filling the inside of the package with the vapor of preserving liquid.

More particularly, the preserving material of the present invention is sued for preserving foodstuffs such as fresh vegetables such as tomato, cucumber, lettuce and cabbage, mushrooms, fruits such as apple, banana, strawberry, peach and pineapple, bread, cakes, meat products such as ham and sausage, marine products, noodles, and flowers such as rose, chrysanthemum and tulip.

Furthermore, oxygen absorbing agent, carbon monoxide generating agent, deodorants such as activated carbon, adsorbents such as silicon dioxide, talc, kaolin, starch can be used together within the scope of the present invention. These materials can be used, for example, putting them into the space between the absorbent sheet and a barrier film.

In addition, aromatic substances (natural and synthetic perfumes, spices, flowers and green leaves) can also be used together. As described above, the preserving material of the present invention is characterized in that it can be produced without difficulty, the soaking in a preserving liquids is easily done in a short time, the packing together with foodstuffs in also easy, and the taste and quality are not deteriorated because both surfaces of adsorbent sheet are covered by barrier films and the preserving liquid is not brought into direct contact with foodstuffs.

Especially in the use of alcohol which evaporates rapidly, the rate of evaporator of the preserving liquid can be easily controlled because the preserving liquid is evaporated and released from only the peripheral edges.

The present invention will be described in more detail with reference to examples

EXAMPLE 1

Nonwoven fabric made of natural pulp of 2 mm in thickness and 500 g/m$^2$ in basis weight was cut into adsorbent sheets of 4×5 cm. Polyethylene films of 50 micron in thickness were thermally bonded to both surfaces of the adsorbent sheet to prepare an adsorbent material of the present invention.

This chip was soaked in ethyl alcohol, wherein the chip was saturated with ethyl alcohol within 5 seconds. The quantity of adsorbed ethanol was 2 g (1 g of adsorbent sheet adsorbed 2 times by weight of alcohol).

This preserving material was sealed in a package together with 600 g of bread. The rate of evaporation of ethanol was 50% per 24 hours.

This package was left as it stands for 1 month but the bread did not gather mold.

COMPARATIVE EXAMPLE 1

Ethanol was adsorbed by 4 g of silicon dioxide, which was saturated with 2 g of ethanol (a half by weight of the silicon dioxide).

This was put into a small paper bag and sealed in a container together with 600 g of bread. Whole the ethanol was evaporated within 8 hours.

There occurred nothing after 2 weeks, however, the bread gathered mold after 1 month.

COMPARATIVE EXAMPLE 2

Only the adsorbent sheet used in Example 1 was soaked in ethyl alcohol. 2 g of alcohol was adsorbed within 2 seconds.

This was sealed in a package together with 600 g of bread. The rate of evaporation of ethanol was 100% after 1 hour.

The bread did not gathered mold after 1 month but it gathered mold after 2 months.

EXAMPLE 2

The adsorbent material in Example 1 was used to adsorb 2 g of preserving liquid consisting of 95% of ethanol and 5% of acetic acid to prepare a preserving material. This was sealed in a package together with 600 g of bread.

The rate of evaporation was 50% after 24 hours. After 2 month' storage, the bread gathered no mold.

COMPARATIVE EXAMPLE 3

2 g of ethanol was absorbed by 1 g of cotton which was packed in a paper bag of 40×50 mm that was made of rice paper of 25 g/m$^2$ in basis weight using starch paste. This was left to stand still at room temperature. After about 4 hours, all the ethanol was evaporated off.

COMPARATIVE EXAMPLE 4

2 g of ethanol was absorbed by 4 g of silicon dioxide which was put in a paper bag of 40×50 mm that was made of rice paper of 25 g/m$^2$ in basis weight using starch paste. This was left to stand still at room temperature. After about 8 hours, all the ethanol was evaporated off.

When this paper bag was picked up with fingers, the part stuck with starch paste was separated and the silicon dioxide was spilt and scattered.

EXAMPLE 3

In the like manner as Example 1, 50 mμ thick low density polyethylene was laminated by extrusion lamination on both sides of natural pulp of 500 g/m$^2$ in basis weight and 2 mm in thickness. 1 g of this laminate of 40×50 mm was soaked in ethanol, as a result, 2 g of ethanol was absorbed. This was left to stand still at room temperature. After 24 hours, only 50% of ethanol was evaporated off.

When this laminate was picked up with fingers, the natural pulp was not scattered at all.

What is claimed is:

1. A preserving material comprising a layered structure of an adsorbent sheet impregnated with a preserving liquid and barrier films which are bonded to only the top and bottom surfaces of said adsorbent sheet before impregnation, said films not being bonded to each other and being characterized in that said barrier films are impermeable to said preserving liquid and said preserving liquid contains at least a lower alcohol and is impregnated into and released from said adsorbent sheet from the peripheral edges of said preserving material.

2. The preserving material in claim 1, wherein said adsorbent sheet is made of a material selected from the group consisting of paper, nonwoven fabric, cotton wool, foamed plastics or plastic sheet which is impregnable with said preserving liquid.

3. The preserving material in claim 1, wherein said barrier film is made of a material selected from the group consisting of polyolefin, polystyrene, polyamide, polyester, polyvinyl chloride, polyvinylidene chloride, saponified product of ethylene vinyl acetate copolymer, polyvinyl alcohol, and aluminum foil.

4. A method for producing a preserving material which consists of the steps of:

bonding barrier films only to the top and bottom surfaces of an adsorbent sheet and not to each other to prepare a layered material; and soaking the obtained layered material in a preserving liquid, thereby impregnating said adsorbent sheet with said preserving liquid from peripheral edges of said layered material said barrier films being impermeable.

5. The method for producing a preserving material in claim 4, wherein said adsorbent sheet is made of a material selected from the group consisting of paper, nonwoven fabric, cotton wool, foamed plastics or plastic sheet which is impregnable with said preserving liquid.

6. The method for producing a preserving material in claim 4, wherein said barrier film is made of a material selected from the group consisting of polyolefin, polystyrene, polyamide, polyester, polyvinyl chloride, polyvinylidene chloride, saponified product of ethylenevinyl acetate copolymer, polyvinyl alcohol, and aluminum foil.

* * * * *

UNITED STATES PATENT AND TRADEMARK OFFICE

CERTIFICATE OF CORRECTION

PATENT NO. : 5,126,109

DATED : June 30, 1992

INVENTOR(S) : Hachiro Saitoh

It is certified that error appears in the above-identified patent and that said Letters Patent is hereby corrected as shown below:

Column 2, line 39: "tetrachlrride" should read as --tetrachloride--

Column 2, line 45: "4,404,340" should read as --4,404,040--

Column 2, line 46: after "No." insert --Re.--

Column 3, line 6: "en" should read as --an--

Column 3, line 21: "a" should read as --as--

Column 5, line 6: "sued" should read as --used--

Column 5, line 32: "evaporator" should read as --evaporation--

Signed and Sealed this

Seventh Day of September, 1993

Bruce Lehman

*Attest:*

BRUCE LEHMAN

*Attesting Officer*

*Commissioner of Patents and Trademarks*